United States Patent [19]

Jiang

[11] Patent Number: 4,637,530

[45] Date of Patent: Jan. 20, 1987

[54] DISPENSER FOR A LIQUID CONTAINER

[76] Inventor: Chih-Chang Jiang, No. 24, Chen-Kang Street 1, Tau-Yuen, Taiwan, 330

[21] Appl. No.: 732,290

[22] Filed: May 9, 1985

[51] Int. Cl.[4] ..... B67D 3/00

[52] U.S. Cl. ..... 222/564; 222/571

[58] Field of Search ..... 222/566, 567, 568, 571, 222/547, 564, 544, 108, 109; 239/590.5, 590

[56] References Cited

U.S. PATENT DOCUMENTS

| | | | |
|---|---|---|---|
| 1,456,408 | 5/1923 | Scherer | 222/564 |
| 1,984,005 | 12/1934 | Young | 222/571 |
| 3,311,275 | 3/1967 | Gibson | 222/564 |
| 3,391,838 | 7/1968 | Gundel | 222/571 |
| 3,632,049 | 1/1972 | Winters | 222/564 |
| 3,833,150 | 9/1974 | Maria et al. | 222/571 |

*Primary Examiner*—F. J. Bartuska
*Assistant Examiner*—Kenneth Noland
*Attorney, Agent, or Firm*—Holman & Stern

[57] ABSTRACT

A liquid dispenser formed separately from or integrally with a container, comprising a cylindrical throat with a pouring spout protruding from one side of the top end of the throat and an annular flange extending around the throat. The dispenser includes at least one vertical arranged flow-interrupting means which may be formed in the pouring spout or both in the pouring spout and in the throat. The flow-interrupting means is disposed substantially perpendicular to the pouring direction of the liquid. The dispenser also includes a tongue provided on the liquid passage of the pouring spout for directing the liquid flow and for recovery of any drop of liquid that may drip down the outer wall of the container after pouring.

5 Claims, 4 Drawing Figures

DISPENSER FOR A LIQUID CONTAINER

BACKGROUND OF THE INVENTION

In dispensing a relatively viscose contents, for example an edible oil such as salad oil, peanut oil or cleaning liquid such as detergent, shampoo, or industrial oil such as machine oil from a container, the surface of the container or even the bottom thereof usually soiled by the liquid dripping and flowing down from the pouring mouth, owing to its high viscosity. This will become more serious as the frequency of pouring increases, which consequently will cause not only waste of the liquid itself but also cause a contamination problem if the contents are a toxic liquid such as a pesticide.

In the past, containers have been developed with one or more recovery holes. The recovery holes in prior art containers have been placed below and generally in line with the portion of the opening in the container over which the fluid flows during pouring. Other containers employ a cap having a plurality of holes therein spaced slightly away from the edge of the container over which the fluid flows. However, with these structural arrangements, it has been found that fluid frequently flows out of the recovery hole during pouring thereby resulting in an uneven and unpredictable fluid flow pattern, and an increased rate of spillage.

SUMMARY OF THE INVENTION

Accordingly, it is an object of this invention to provide an improved liquid dispenser that will substantially prevent fluid from dripping down the outer wall of the container after pouring.

It is another object of the subject invention to provide a liquid dispenser that will substantially prevent the fluid from remaining on the outside of the container in between successive uses of the container.

It is an additional object of the subject invention to provide an dispenser that can easily be adapted for use with most containers.

It is still another object of the subject invention to provide a dispenser that will both prevent acumulation and dripping of fluid while also providing desirable fluid flow from the container.

DETAILED DESCRIPTION OF THE PREFERRED EMBODIMENT

The present invention will be described by way of example with reference to the accompanying drawings.

Figure 3:
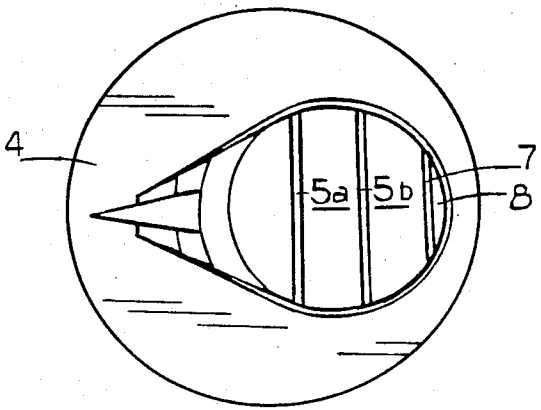
FIG. 3 is a sectional view taken substantially along the center of the dispenser of the subject invention.
Figure 2:
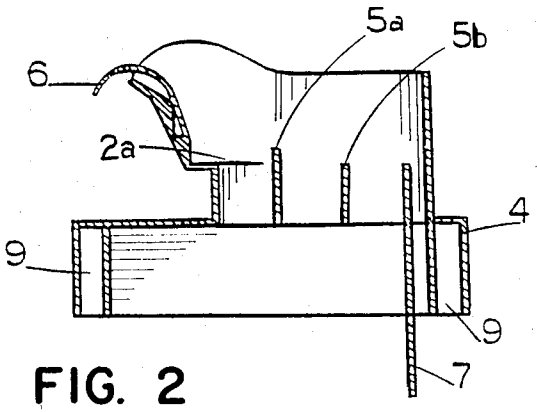
FIG. 2 is a top plan view of the subject invention.
Figure 1:
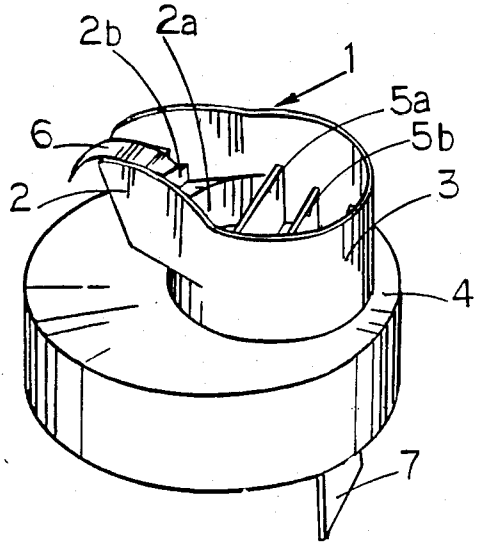
FIG. 1 is a perspective view of one embodiment of the subject invention.

Referring now to FIG. 1, a dispenser is generally designated by the numeral 1, which may either be constructed integrally with a container or affixed to the open top of a container.

The dispenser 1 includes a generally cylindrical throat portion 3 with a pouring spout or month 2 protruding from one side of the top end of the throut 3 and an annular flange or collar 4 formed at the lower portion surrounding the throat 4. The flange 4 extends outwardly from the throat 3 to a point beyond the leading portion of the pouring spout 2 over which the fluid flows during pouring.

The throat portion 3 includes at least one vertically positioned flow-interrupting plate 5 transversely arranged within the inner wall of the throat 3. More particularly, the flow-interrupting plate 5 is disposed within the throat 3 in a manner substantially perpendicular to the axial line of the pouring spout 2 or pouring (or flowing) direction of the liquid contained in the container. In drawings, the dispenser 1 includes two spacedly arranged flow-interrupting plates 5*a* and 5*b*.

The two plates 5*a* and 5*b* are so arranged that the upper edge of the plate 5*a* near the pouring spout 2 is positioned substantially in the same plane with the lowest step 2*a* formed on the liquid pouring path of the spout 2, while the upper edge of the plate 5*b* remote from the pouring spout 2 is positioned at a level lower than the upper edge of the plate 5*a*, and the lower edges of the plates 5*a* and 5*b* are extended to or near the lower edge of the throat 3.

As can be seen from the drawings, on the liquid flowing path of the pouring spout 2 there are formed plurality of steps 2*a*, 2*b* having a vertical wall portion arranged in parallel to the aforesaid plate 5, which effect the same function as plates 5*a* and 5*b*.

Adjacent to the inner wall of the throat 3 opposite the pouring spout 2, an additional plate 7 is formed in parallel to the plates 5*a* and 5*b* and the lower end of which extend beyond the lower edge of the collar 4 as clearly shown in FIG. 1.

The spaces a, b and c defined respectively by the inner wall of the throat 3 and plate 5*a*, plates 5*b* and plate 7 as well as plates 5*a* and 5*b* allow liquid to pass through during pouring, while the space designates by numeral 8 is for inflowing of air into the interior of the container during pouring.

Numeral 6 is a tongue-like thin curved plate (hereinafter simply refer to tongue) having a sharp leading point and a broad end portion.

The end portion of the plate 7 is secured on the intermediate portion of the liquid pouring path of the spout 2 so that substantial part of the plate 7 is bridged over the leading end of the spout 2. The tongue 7 effects a very peculiar fuction as will be described hereinafter.

Figure 4A:
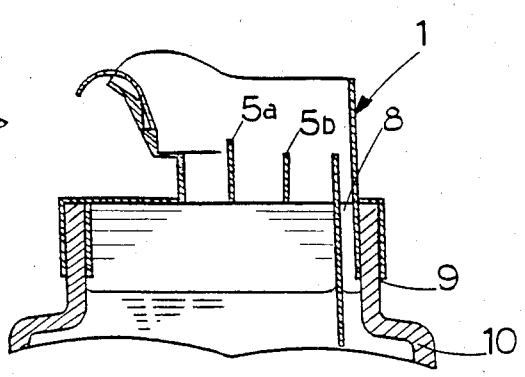
FIG. 4 shows schematic views illustrating the use of the subject invention.
Figure 4B:
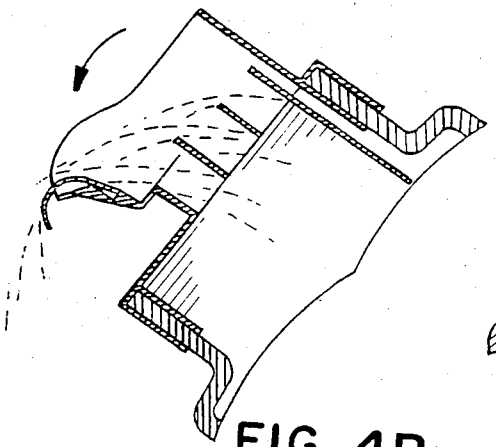
Figure 4C:
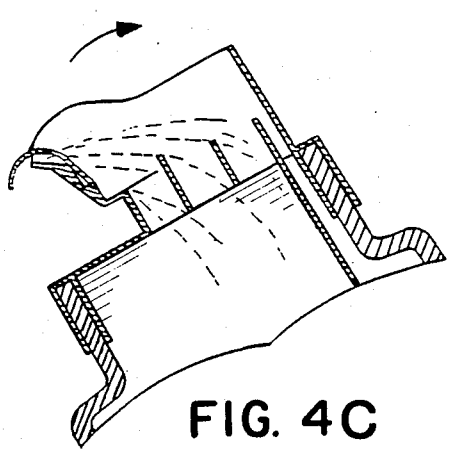

9 is a annular groove formed along the inner wall of the flange 4 for affixing to the open top of a container as shown in FIG. 4.

The pouring operation of a container having the present dispenser is illustrated in FIG. 4.

When the liquid container 10 is tilted from upstanding position A to a pouring position B, the liquid will pass through spaces a, b and c, and flow over the plates 5*a*, 5*b* toward the pouring spout 2, and finally flow out from the tongue 7. When the pouring of liquid is completed and the container is put back into its standing position C along the direction shown by an arrow, the liquid flow will be first hindered or interrupted by counter directional movement of the plates 5*b* and 5*a* and subsequently interrupted by the vertical walls formed on the steps 2*a* and 2*b*. Thus the outflowing energy of the liquid will be substantially attenuated, allowing a minimized liquid to flow into the flowing path of the pouring spout 2. The liquid is so minimized in amount that it will not drip down the outer wall of the container and, on the contrary, will flow into the container, when the container resumes it upspanding position. Any liquid that may remain on the tongue or vicinity thereof will first flow down the tongue 6 and suspend at the leading point of the tongue 6 as a dew drop. This drop of liquid then, by virtue of its viscosity and coherency, will flow along the under surface of the tongue 6 and return to the flowing path of the pouring spout 2 and finally flow into the interior of the container.

Furthermore, since an air inlet space 8 is formed at the opposite side of the pouring spout, it will serve as a vent through which air from the atmosphere may flow into the container, as the contents are dispensed, to prevent formation of a vacuum in the container and help improve the smooth flow of liquid. Therefore, by using the dispenser of the subject invention the following advantages can be obtained:

1. The flow of energy of liquid can be substantially attenuated by the flow interrupting means therefore only a minimized liquid is allowed to flow into the pouring spout, when the container resumes its upstanding position.

2. Any liquid that may spill from the container after it has been returned to a standing position following a pouring operation can be recovered by virtue of the tongue.

3. The air inlet space contributes to a smooth flow of liquid and even if a great amount of liquid is poured, there will not cause any pulsation.

While the invention has been described and illustrated with respect to a preferred embodiment, it is obvious that various modifications can be made therein without departing from the spirit of the present invention which should be limited only by the scope of the attached claims.

What is claimed is;

1. A liquid dispenser, comprising a cylindrical throat with a pouring spout protruding from one side of the top end of the throat the spout having a pouring direction perpendicular to a direction of flow through the throat, and an annular flange extending around the throat, said dispenser includes a plurality of substantially parallel vertically arranged flow-interrupting means formed in the pouring spout and throat, said flow-interrupting means extending upwardly to different levels respectively and being disposed substantially perpendicular to the pouring direction of the liquid through the spout, and said dispenser includes a tongue provided on the liquid passage of the pouring spout for directing the liquid flow and for recovery of any drop of liquid that may drip down the outer wall of the container after pouring.

2. A liquid dispenser as claimed in claim 1 wherein the flow-interrupting means includes at least one plate formed in the throat.

3. A liquid dispenser as claimed in claim 1 wherein the flow-interrupting means includes at least one step having a vertical wall formed in the pouring spout.

4. A liquid dispenser as claimed in claim 1 wherein the tongue is a thin curved plate having a sharp leading point and a broad end portion, said end portion being secured on the intermediate of the liquid pouring path that substantial part of said plate being bridged over the leading end of the spout.

5. A liquid dispenser as claimed in claim 1, wherein the annular flange is provided with a groove adapted for affixing on the open top of the container.

* * * * *